United States Patent [19]

Heiman et al.

[11] Patent Number: 5,001,785

[45] Date of Patent: Mar. 26, 1991

[54] HOSPITAL-TYPE GOWN HAVING IMPROVED CUFFS ON THE SLEEVES THEREOF

[75] Inventors: Mark J. Heiman, Maineville, Ohio; Frank C. Long, Ozark, Ala.

[73] Assignee: Standard Textile Company, Inc., Cincinnati, Ohio

[21] Appl. No.: 351,375

[22] Filed: May 9, 1989

[51] Int. Cl.[5] ..... A41B 7/00

[52] U.S. Cl. ..... 2/123; 2/114; 2/51

[58] Field of Search ..... 2/114, 123, 51

[56] References Cited

U.S. PATENT DOCUMENTS

| | | | |
|---|---|---|---|
| 3,868,728 | 3/1975 | Krzewinski | 2/114 |
| 4,114,200 | 9/1978 | Smith et al. | 2/123 |
| 4,389,734 | 6/1983 | Franz et al. | 2/114 |
| 4,504,977 | 3/1985 | King et al. | 2/114 |
| 4,504,978 | 3/1985 | Gregory, Jr. et al. | 2/114 |
| 4,535,481 | 8/1985 | Ruth-Larson et al. | 2/114 |
| 4,586,196 | 5/1986 | White | 2/114 |
| 4,603,440 | 8/1986 | Hale | 2/123 |
| 4,736,467 | 4/1988 | Schwarze et al. | 2/114 |
| 4,752,972 | 6/1988 | Neckerman | 2/123 |

*Primary Examiner*—Werner H. Schroeder
*Assistant Examiner*—Gloria Hale
*Attorney, Agent, or Firm*—Kinney & Schenk

[57] ABSTRACT

A hospital-type gown and method of making same are provided wherein such gown has a main body and sleeves each terminating in a cuff at the terminal outer end thereof, a fabric shield is provided disposed inside each cuff which serves as a barrier for any fluids which pass through the cuff.

1 Claim, 1 Drawing Sheet

HOSPITAL-TYPE GOWN HAVING IMPROVED CUFFS ON THE SLEEVES THEREOF

BACKGROUND OF THE INVENTION

1. Field of the Invention

This invention relates to a hospital-type gown which may be in the form of a launderable gown, and in particular to a gown of the type used by doctors, nurses, nurse's aides, and the like.

2. Prior Art Statement

Hospital-type gowns are widely used in hospitals, nursing homes, rest homes, doctor's offices, and the like by health professionals, such as doctors, nurses, nurse's aides, and the like; and, particularly where there is the possibility of coming into contact with contaminated body fluids, every effort is made to protect the health professional. Health professionals routinely use (wear) such hospital-type gowns to either perform surgery or assist in surgery, draw blood, work with specimens containing contaminated fluids, or work where there might be a spill of contaminated fluids. Especially in instances where patients may have Acquired Immunity Deficiency Syndrome (AIDS), the health professional wants to have as much protection as possible.

Hospital-type gowns proposed heretofore usually are provided with sleeves each terminating in a cuff at the outer end which is usually in the form of a stretchable cuff made of stockinette material. Ordinarily the stretchable stockinette cuffs of prior art gowns do not have optimum hydrophobic properties. Even though health professionals such as nurses, for example, often wear short stretchable rubber gloves with their prior art gowns, such gloves often do not completely cover the cuffs of their gowns leaving exposed areas at the upper ends of such cuffs. Thus, present hospital-type gowns have a deficiency in that the stretchable cuffs provided at the outer ends of sleeves of such gowns do not provide protection against liquid permeating therethrough.

SUMMARY OF THE INVENTION

This invention provides a new hospital-type gown for health professionals, and the like, which helps to correct the above-mentioned deficiency.

In particular, this invention provides a new hospital-type gown having a main body and sleeves each terminating in a cuff at the terminal outer end thereof.

In accordance with one embodiment of this invention, such new hospital-type gown comprises a fabric shield disposed inside each cuff and serving as a barrier for any fluids which pass through the cuff.

This invention also provides a new launderable hospital-type isolation gown having a main body and sleeves each terminating in a stretchable cuff at the terminal outer end thereof.

In accordance with one embodiment of such isolation gown, the main body and sleeves are made of woven hydrophobic fabric and such gown further comprises a woven hydrophobic fabric shield disposed inside each cuff and serving as a barrier for any fluids which pass through the cuff.

Accordingly, it is an object of this invention to provide a hospital-type gown of the character mentioned.

Other features, objects, uses, and advantages of this invention are apparent from a reading of this description which proceeds with reference to the accompanying drawings forming a part thereof.

BRIEF DESCRIPTION OF THE DRAWINGS

The accompanying drawings show present preferred embodiments of this invention, in which.

DESCRIPTION OF PREFERRED EMBODIMENTS

Figure 1:
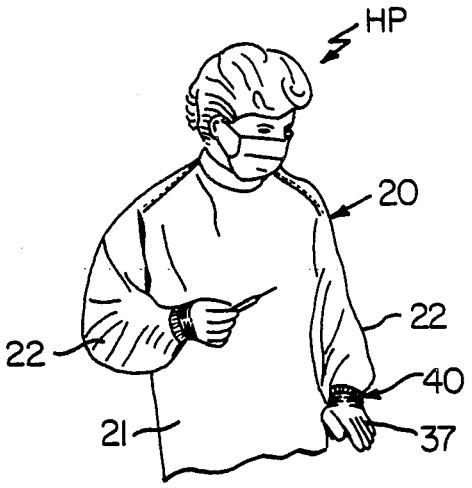
FIG. 1 is a view with parts broken away illustrating one exemplary embodiment of a hospital-type gown of this invention being worn by a health professional, with the gown of FIG. 1 having a main body and a pair of substantially identical sleeves.

While the various features of this invention are hereinafter illustrated and described as being particularly adapted to provide a hospital-type gown for use by health professionals, it is to be understood that the various features of this invention can be utilized singly or in various combinations thereof to provide gowns for other uses as desired.

Therefore, this invention is not to be limited to only the embodiments illustrated in the drawings, because the drawings are merely utilized to illustrate an exemplary one of the wide variety of uses of this invention.

Reference is now made to FIG. 1 of the drawings which illustrates one exemplary embodiment of a hospital-type gown of this invention with such gown being used, i.e., worn, by a health professional (HP) and such gown is designated generally by the reference numeral 20. The gown 20 is of the type utilized by health professionals in hospitals, nursing homes, rest homes, clinics, doctors'offices, and the like.

Figure 2:
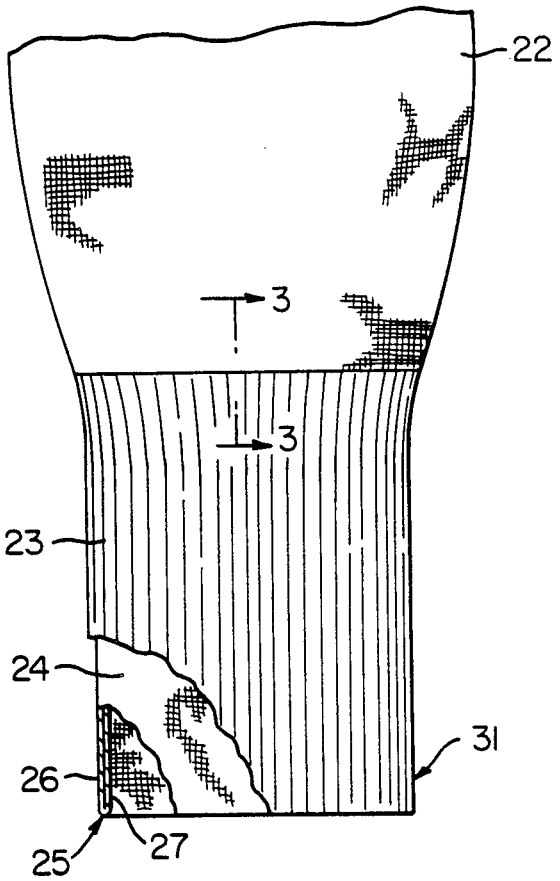
FIG. 2 is an enlarged fragmentary view with parts broken away particularly illustrating the outer end of a typical sleeve of the gown of FIG. 1.

The gown 20 is a launderable gown in the form of an isolation gown; and, such gown has a main body 21 and substantially identical sleeves each designated by the same reference numeral 22. As seen in FIG. 2, each of the sleeves 22 terminates in a stretchable cuff 23 at the terminal outer end thereof.

Figure 3:
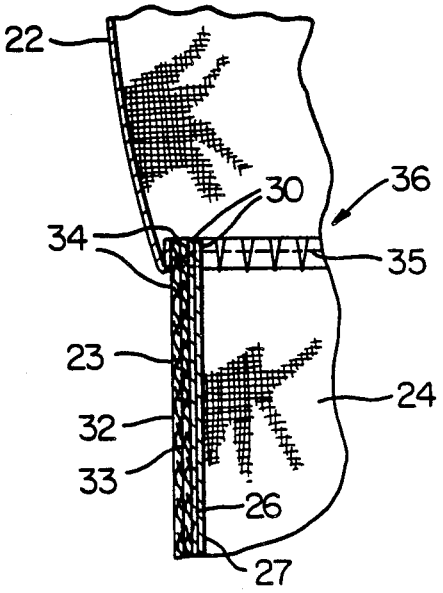
FIG. 3 is a fragmentary cross-sectional view taken essentially on the line 3—3 of FIG. 2.

The main body 21 and sleeves 22 are preferably made of a woven hydrophobic fabric of any suitable type known in the art and the gown 20 comprises a woven hydrophobic fabric shield designated generally by the reference numeral 24 disposed inside each cuff 23. Each cuff 23 serves as a barrier for any fluids which pass through such cuff. As will be readily apparent from FIGS. 2 and 3, the shield 24 is a double-thickness shield and is preferably comprised of a seamless tubular member having an end portion inverted on itself to define an outer folded end 25 adjoined by two tubular portions 26 and 27 terminating in shield inner ends each designated by the same reference numeral 30.

In a similar manner as illustrated and described for the shield 24, the cuff 23, which is a stretchable cuff, has an end portion inverted on itself to define an outer stretchable folded end 31 adjoined by two tubular portions 32 and 33 terminating in cuff inner ends, each designated by the same reference numeral 34.

Each cuff 23 with its shield 24 disposed therein is fastened to an associated sleeve with suitable fastening means. The fastening means may be any suitable means known in the art but is preferably in the form of stitch means or stitches 35. The stitches serve to fasten the shield inner ends 30 and cuff inner ends 34 to the terminal end of the sleeve 22 and as shown at 36 in FIG. 3.

The stretchable cuff 23 of this example is shown and described as a seamless cuff and is preferably made of a stockinette tubular material. Such stockinette tubular material may be a synthetic material in the form of polyester. However, it will be appreciated that such cuff 23 may be made of any suitable material known in the art.

The main body 21 of the gown 20, sleeves 22 and shield 24 are preferably made of woven fabric material comprised of yarns each made of a plurality of continuous filaments of a type well known in the art and such filaments are preferably made of synthetic material. The synthetic material defining the filaments and, hence, the yarns and fabric is preferably polyester.

Thus, it is seen that with the construction illustrated and described herein, the gown 20 is provided with a double-thickness fabric shield 24 disposed inside each cuff 23 and each shield serves as a barrier for any fluids which pass through the cuff.

It will be appreciated that in instances in which a health professional HP utilizes rubber gloves 37, or the like, in which a portion of a cuff 23 is exposed above a typical rubber glove 37 as shown at 40 in FIG. 1, for example, the shield 24 of this invention serves to provide improved protection for the health professional against fluids that might pass through the cuff 23.

It will be appreciated that any suitable fabric material having hydrophobic properties may be utilized to define the shield 24, and the main body 21 and sleeves 22 of the gown 20. However, it is to be understood that the shield 24 need not necessarily be made of the same hydrophobic material as the main body 21 and the sleeves 22 of such gown. Similarly, any suitable hydrophobic material may be utilized to define the cuffs 23.

Preferably the materials used to make the gown 20 with its components 21, 22, 23, and 24 are such that the gown is launderable. However, the concept of this invention is fully applicable to a disposable type hospital-type gown in which the sleeves terminate in cuffs wherein fabric shields having hydrophobic properties and in accordance with the teachings of this invention are disposed in the cuffs of such a disposable gown.

In this disclosure of the invention, terms such as inner, outer, etc., have been used throughout; however, it is to be understood that these terms have been utilized for ease of description and should not be considered as limiting the scope of this invention in any way.

While forms and methods of this invention, now preferred, have been illustrated and described as required by the Patent Statute, it is to be understood that other forms can be utilized and still fall within the scope of the appended claims wherein each claim sets forth therein what is believed to be known in the art prior to this invention in that portion of each claim that is presented before the term "the improvement" and sets forth what is believed to be new in the art according to this invention in that portion of each claim that is presented after the term "the improvement" wherein it is believed that each claim sets forth a novel, useful, and unobvious invention within the purview of the Patent Statute.

What is claimed is:

1. In a hospital-type gown comprising a main body and sleeves, said sleeves and at least a portion of said main body being formed of a hydrophobic fabric, and wherein each sleeve has a cuff attached to its outer end, the improvement wherein each cuff comprises a polyester, stretchable, stockinette, tubular member, folded on itself to provide a folded outer end and tubular portions which engage each other and extend to the sleeve to which the cuff is attached, and a tubular shield disposed wholly within and engaged by said stockinette tubular member, characterized in that the tubular shield is formed of a hydrophobic fabric tubular member, tightly woven from continuous filament, polyester yearn, and is in the form of a seamless tubular member folded on itself and comprising a folded outer end, spaced outwardly from the sleeve at least as far as the outer end of the stockinette tubular member, said hydrophobic tubular member having tubular portions which engage each other and extend from the outer end thereof to the sleeve to which the cuff is attached, and common stitch means attaching said stockinette tubular member and said hydrophobic tubular member to said sleeve.

* * * * *